United States Patent [19]

Facuseh

[11] Patent Number: 4,534,670

[45] Date of Patent: Aug. 13, 1985

[54] CLEANING DEVICE

[76] Inventor: Elias Facuseh, 1147 SW. 78 Ct., Miami, Fla. 33144

[21] Appl. No.: 552,111

[22] Filed: Nov. 16, 1983

Related U.S. Application Data

[63] Continuation of Ser. No. 411,304, Aug. 25, 1982.

[51] Int. Cl.[3] ..... A46B 11/04; A47L 13/22; B26B 11/00

[52] U.S. Cl. ..... 401/270; 15/104.53; 132/DIG. 3

[58] Field of Search ..... 401/183, 184, 185, 186, 401/132, 133, 134, 135, 136, 270, 269, 275, 276; 222/191, 206, 207, 209; 15/104.5, 104.53, 104.54

[56] References Cited

U.S. PATENT DOCUMENTS 2,743,042 4/1956 Burgin ..... 222/191
4,149,814 4/1979 Manwaring ..... 401/269

FOREIGN PATENT DOCUMENTS 607844 9/1948 United Kingdom ..... 15/104.54

*Primary Examiner*—Richard J. Apley
*Assistant Examiner*—Carolyn A. Harrison
*Attorney, Agent, or Firm*—John Cyril Malloy

[57] ABSTRACT

A cleaning device specifically designed for use in the cleaning of combs or similarly shaped tools or devices wherein the comb being cleaned is repeatedly moved into engagement with cleaning brushes movably mounted on a housing in direct receiving position to soap or like cleaning fluid selectively issuing from a compartment formed on the interior of the housing itself.

4 Claims, 6 Drawing Figures

CLEANING DEVICE

This is a continuation of application Ser. No. 411,304 filed Aug. 25, 1982.

BACKGROUND OF THE INVENTION

1. Field of the Invention

This invention relates to a cleaning device primarily designed for the cleaning of combs or similarly shaped structures wherein a housing mounts cleaning brushes and also a soap storage compartment wherein manual movement or manipulation of the comb relative to the brushes provides a scrubbing action thereon which may occur simultaneously to selective application of the soap on the brushes and therefore on the comb itself.

2. Description of the Prior Art

Various devices exist in the prior art and are now currently commercially available designed for the cleaning of specific tools or devices. The existence of such cleaning structures is generally due to the fact that conventional manual cleaning techniques such as hand scrubbing, washing, soaking, etc. are either not effective to adequately clean a given device or are generally too burdensome or time consuming.

The cleaning of combs or similar shaped "blade" tools or devices is particularly troublesome. This is due to the fact that regardless of the size of the comb, each usually contains a large number of closely spaced teeth positioned in substantially parallel relation to one another. The close spacing of such teeth presents difficulties or problems for the effective cleaning of comb structures. Such cleaning problems are enhanced when one considers the comb is frequently used to comb hair on which grooming oils, greases, hair sprays, etc. have been placed. Therefore, dust or dirt particles are lodged between the teeth of the comb and are maintained in these rather small spaces due to the existence therein of hair oils, greases, etc.

Common techniques such as manual washing or scrubbing with the fingers is clearly not adequate since the dust or dirt particles cannot easily be reached. This is true even when large amounts of soaps or solvents are used to dislodge such grease ladden particles.

Accordingly, there is clearly a need in the art for a device specifically designed for the cleaning of combs wherein such device is structured to easily and efficiently remove unwanted dirt particles from between normally closely spaced teeth of the comb. Such device should be of simple design and construction, thereby allowing for low initial cost to the consumer and further eliminating or reducing the need for maintenance service being performed thereon. The preferred device should be capable of being effectively "self-contained" to the extent that cleaning of a comb structure can occur in a simple one or two step process by the application of cleaning fluid directly to cleaning brushes or like structures. This will eliminate the need for supplementary application of soap or similar type cleaning fluids.

SUMMARY OF THE INVENTION

The present invention is directed towards a cleaning assembly or structure specifically designed for the cleaning of combs or other similarly shaped tools or devices. While the structure of the present invention is specifically designed to provide efficient and adequate cleaning of a multi-tooth comb, it is readily apparent that the overall design of the subject cleaning assembly is such as to provide efficient cleaning or scrubbing action of other similarly configured elongated "blade" type tools or devices.

More specifically, the structure of the present invention comprises a housing having cleaning means mounted thereon in the form of a plurality, and preferably two, roller brushes. The roller brushes are, in the preferred embodiment, disposed between two outwardly extending arm elements wherein the brushes are rotatable therebetween and disposed in substantially parallel, interengaging or intermeshing position. The bristles of each roller brush elements are such as to substantially engage or become intermeshed with the bristles of the opposite roller brush element along a common area of engagement. However, the dimension and spacing of such roller brush elements is such as to allow the comb or like device being cleaned to pass therebetween. This passage of the comb between the roller brush elements causes a rotation of both and provides an effective scrubbing or cleansing action by the bristles of each brush on opposite sides of the comb being cleaned. This provides effective cleaning between the various teeth of the comb.

The housing further includes a hollow interior portion specifically dimensioned and structured to define compartment means therein. This compartment means includes a first compartment designed for the storage of a soap or like cleansing fluid therein. An exit means forms part of this first compartment and is positioned to direct the soap or cleansing fluid from the interior of the housing directly onto the roller brushes upon application of an activating means, which will be described in greater detail hereinafter. The compartment means further includes a second compartment disposed in direct fluid communication with the first compartment. The second comartment is preferably somewhat smaller in shape so as to allow fluid which may be air, or cleansing fluid therein to selectively pass into the first compartment through proper valving means. The passage of such fluid is accomplished through the manipulation of an activating means.

The activating means comprises a flexible portion in the form of a diaphragm disposed in direct fluid communication with the first compartment in a manner so as to effectively define a portion of the interior of the first compartment. Accordingly, inward displacement or depressed positioning of the flexible diaphragm causes the volume within the second compartment to contract forcing, under pressure, a fluid therein to pass through proper valving means into the first compartment. This has the effect of forcing the cleansing fluid therefrom through the exit means of the first compartment directly onto the roller brush elements. Repeated depression and expansion or reciprocal depression of the flexible diaphragm causes a constant squirting or pulsing of the cleansing fluid from the first compartment in a manner described above. This procedure may be repeated until the proper or desired amount of soap or cleansing fluid is issued or directed from the first compartment onto the cleansing brushes.

The soap or cleaning fluid is placed on the interior of the housing, in the compartment means through an access means in the form of a cap. The cap is preferably located at one end of the handle or the housing which may be removable and tightly fitted in place so as to prevent leakage of the soap from the housing. Proper vent means are applied in direct fluid communication with the aforementioned valving means so as to allow venting of the interior of the housing upon reciprocal movement of the activating means.

Accordingly, the above structure accomplshes an effective and efficient cleaning assembly for the thorough cleaning of combs or similarly shaped tools or devices in a manner which is greatly superior to the manual washing, soaking, or scrubbing of such devices.

BRIEF DESCRIPTION OF THE DRAWINGS

For a fuller understanding of the nature of the present invention, reference should be had to the following detailed description taken in connection with the accompanying drawings, in which.

Similar reference characters refer to similar parts throughout the several views of the drawings.

DETAILED DESCRIPTION OF THE PREFERRED EMBODIMENT

Figure 1:
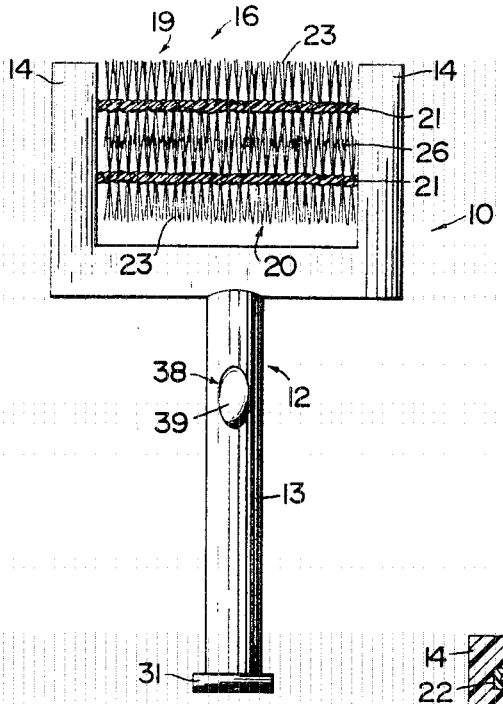
FIG. 1 is a front plan view of the subject cleaning assembly.
Figure 2:
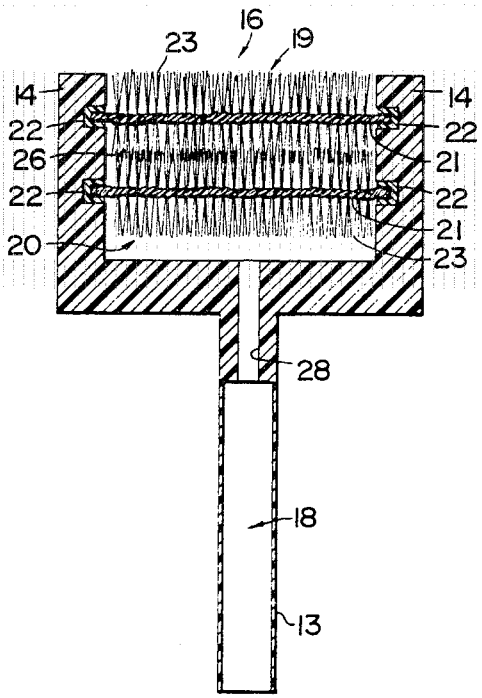
FIG. 2 is a sectional view of the embodiment of FIG. 1.

As shown in FIG. 1 the present invention is directed to a cleaning assembly generally indicated as 10 for a comb or similarly shaped structure. The cleaning assembly comprises a housing 12 including a main body or handle portion 13. Two spaced part and parallel arm members 14 are integrally formed on the housing 12 and are specifically disposed to house cleaning means generally indicated as 16 therebetween. The housing may be formed of a plastic or other strong, lightweight material and as shown in FIGS. 2 and 3, includes a hollow interior portion defining compartment means 18 therein.

The cleaning means 16 preferably comprises two roller brush cleaning elements 19 and 20 having opposite ends of their central axle 21 mounted in bushings 22. This mounting allows free rotation of both roller brush cleaning elements 19 and 20 relative to one another and to the arms 14. Such rotational movement occurs upon passage of a comb or between the brushes. It will be noted that the outwardly extending bristle elements 23 of each roller brush 19 and 20 is structured, disposed and dimensioned to provide a slight intermessing engagement at their junction 26. This intermeshing engagement allows the passage of a comb or like tool being cleaned to pass between the brushes in a reciprocal fashion due to the flexibility of the bristles themselves. Such reciprocal movement of the comb element between the brushes causes rotation of both brushes and an engagement of the bristles of both brush elements on opposite sides of the comb and between the various teeth of the comb.

As will be explained in greater detail hereinafter, cleaning fluid or soap issuing from the compartment means or interior of the housing is directed through exit channel 28 onto the lower positioned roller brush 20. Rotation of both brush elements through the reciprocal application of a comb therebetween causes transfer of any soap or cleaning fluid on the lower brush to be directed onto the upper brush as both brushes rotate in meshing engagement with one another.

Figure 3:
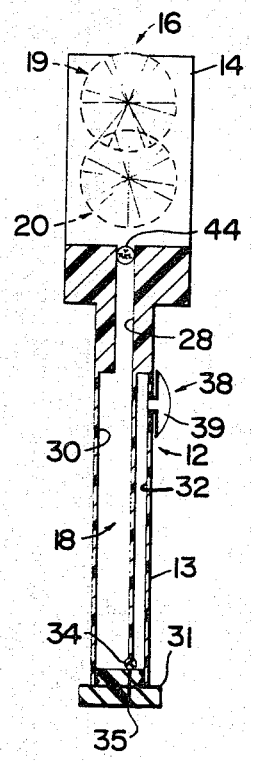
FIG. 3 is a side sectional view showing interior details of the preferred embodiment of the present invention.
Figure 4:
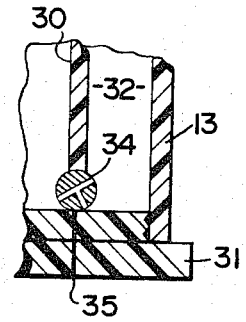
FIG. 4 is a partial cutaway view in detail showing structural features of the valve means of the present invention.
Figure 5:
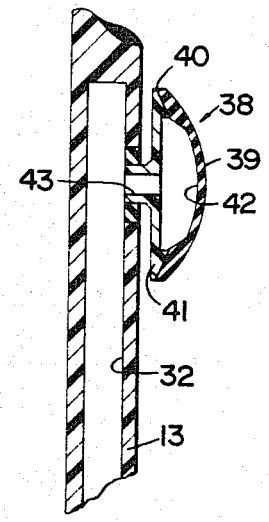
FIG. 5 is a sectional view in partial cutaway showing structural details of the activating assembly of the present invention.

With regard to FIGS. 3, 4 and 5, the compartment means 18 comprises a first compartment 30 primarily designed for the storage or placement of cleaning fluid such as soap or the like therein. Access to the compartment means 18 occurs through an access means in the form of a cap element 31 which may be removed and secured to the end of the handle portion 13 as best shown in FIGS. 3 and 4. As set forth above, the first compartment 30 includes an exit aperture or channel 28 which directs or channels the cleaning fluid contained therein directly through channel 28 onto the lowermost roller brush element 20. Valve means, to be described hereinafter, is provided to prevent reverse flow of the cleaning fluid back into the first compartment 30 through channel 28 and force its application onto the lowermost roller brush 20.

The compartment means 18 comprises a second compartment 32 being somewhat smaller and substantially segregated from the first compartment 30. This segregation is basically structural in nature as shown in FIG. 3. However, the first compartment 30 and second compartment 32 are disposed in direct fluid communication with one another through valve means defined in part by a first valve assembly 34 (FIG. 4). With reference to FIG. 4, the first valve ssembly 34 is represented as a three-way flow valve which regulates fluid flow from the second compartment 32 to the first compartment 30 and also fluid flow from the exterior of the housing 12 through cap 31 by virtue of the existence of a vent means 35 formed therein.

Understanding of the fluid flow throughout the compartments and through the vent means 35 will become clear upon explanation of the structure and operation of the activating means generally indicated as 38 (FIG. 5). This activating means comprises a flexible portion in the form of a diaphragm 39 formed from a flexible material and secured about its periphery 40 to a support base 41. The interior of the activating means 38, generally indicated as 42, is disposed in direct fluid communication with the interior of the second compartment 32 by virtue of a connecting channel 43. Accordingly, and for purposes of explanation, the interior of the second compartment 32 is at least partially defined by the interior of the activating means 38. Due to the flexibility of diaphragm member 39, its positioning into a depressed position will cause the volume within the second compartment to contract thereby forcing fluid under pressure through the first valve assembly 34 into the first compartment 30. This additional pressure will therefore force cleaning fluid or soap out through the exit channel 28 and from the housing onto the cleaning means and more specifically, the lowermost roller brush cleaning element 20. The valve means of the present invention further comprises a one way check valve 44 which, as set forth above, prevents reverse flow of the exiting cleaning fluid back into the first compartment 30 through the channel 28. Since depression of the flexible diaphragm 35 causes a contraction of the effective volume of second compartment 32 any fluid, which may be air, will necessarily be forced under pressure through the first valve assembly 34 into the second compartment 30. Such added fluid pressure forces cleaning fluid from the first compartment 30 onto the cleaning means generally indicated as 16 in a selective manner. The flexibility of the material of the diaphragm 39 causes it to be positioned, after depression into its outwardly extended position as shown in FIG. 5. This is permitted since air from the exterior of the housing 12 passes through vent 35, through the first valve assembly 34 (see FIG. 6) into the second compartment 32 allowing the expansion of the flexible diaphragm 39. It should readily be seen therefore that the diaphragm 39 may be repeatedly depressed and allowed to expand outwardly into its normally extended position (see FIG. 5) so as to repeatedly cause a given or preselected amount of cleaning fluid to exit, in the manner set forth above, from the first compartment 30 past check valve 44. When the diaphragm 39 is repeatedly depressed a pulsing action or pulsing stream of cleaning fluid or soap will therefore be applied to the cleaning means 16 until the desired amount is attained and placed on the comb or like device being cleaned.

Figure 6:
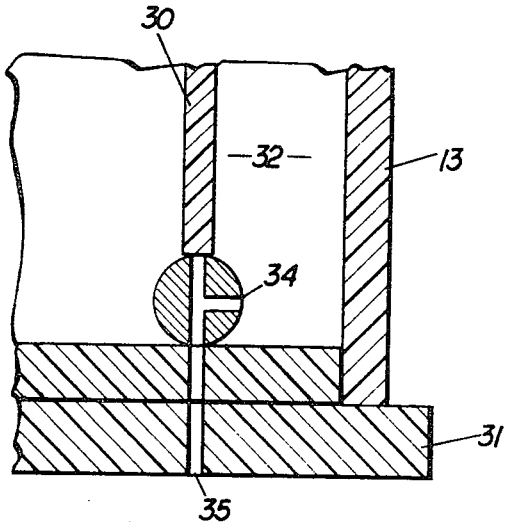

Specifically with regard to the operation of the first valve assembly 34, and as set forth above, fluid communication is established for fluid flow between compartment 32 and compartment 30 upon depression of the activating, flexible diaphragm 39. The position of valve 34 to establish this fluid flow is shown in FIG. 4. With reference to FIG. 6, it is seen that positioning of valve assembly 34 into aligned relation with vent 35 serves to establish fluid flow between the exterior of the housing and the second compartment 32 upon the expansion or outward extension of the flexible diaphragm 39 into its normal position as shown in FIG. 5.

It should be noted that other structural features of the present invention could include the flexible diaphragm member 39 being placed directly into the wall of the handle portion 13 of the housing. An important feature of the subject structure is to allow the depression and extension of the diaphragm member 39 to directly effect the volume within the second compartment. This repeatedly directs fluid flow under pressure into the second compartment and cleaning fluid out of the exit channel 28 through the check valve 44 which defines the second valve assembly of the overall valve means.

What is claimed is:

1. A cleaning assembly for a comb or like device, said cleaning assembly comprising:

(a) a housing having cleaning means attached thereto in accessible position for cleaning of a given device, said cleaning means including at least two cleaning elements each rotatably mounted on said housing and positioned in a substantially stacked, parallel relation to one another, said cleaning element being structured for intermeshing engagement with one another, whereby rotation of one of said cleaning elements causes rotation of the other of said cleaning elements, (b) a first compartment and a second compartment each integrally formed on the interior of said housing and disposed in adjacent relation to one another, said housing including a common wall extending along the length of both said first and said second compartments and disposed in physically segretating relation thereto, (c) valve means for regulating passage of fluid into and out of said housing and comprising a first valve assembly and a second valve assembly, said second valve assembly disposed and structured to regulate fluid flow from said first compartment directly onto at least one of said cleaning elements, (d) said first valve assembly movably mounted in said common wall between a first position establishing fluid flow from said second compartment to said first compartment and a second position establishing fluid flow from an exterior of said housing to said second compartment, (e) said first compartment having a hollow interior portion structured for storage of cleaning fluid therein and disposed for delivery of the cleaning fluid directly to said cleaning means via said second valve assembly, (f) said second compartment having a hollow interior structured for containment of air therein and disposed in cooperative, fluid communication with said first valve assembly to provide exclusion of cleaning fluid from said second compartment interior and air passage from said second compartment to said first compartment and subsequently from an exterior of said housing into said second compartment, (g) activating means disposed and structured to substantially define a portion of the interior of said second compartment and including a flexible wall portion capable of displacement between a first driving position and a second driving position thereby changing the effective volume of said second compartmemt, (h) said first valve assembly positionable in said first position upon inward placement of said flexible wall portion by depression of said activating means into said first driving position, said first valve assembly positionable in said second position upon expansion of said flexible wall portion defining said second driving position of said activating means, (i) said first driving position of said activating means defined by air flow from said second compartment to said first compartment via said first valve assembly and concurrent cleaning fluid flow from said first compartment to said cleaning means, (j) vent means mounted on said housing for supplying air to the interior thereof and being disposed in direct fluid communication of said first valve assembly, said first valve assembly structured and disposed to interconnect said second compartment with said vent means independent of said first compartment when said actuating means assumes said second driving position, and (k) whereby cleaning fluid is forced directly from said first compartment to said cleaning means and in segregated relation to said second compartment.

2. A cleaning assembly as in claim 1 wherein said second valve assembly comprises a one-way check valve structured to establish fluid flow from said first compartment to said cleaning means upon depression of said flexible wall portion of said activating means into said first driving position and blocking fluid flow from said cleaning means to said first compartment upon expansion of said flexible wall portion of said activating means into said second driving position.

3. A cleaning assembly as in claim 1 wherein each of said cleaning elements comprise a roller brush having bristle means extending outwardly therefrom into substantially cooperative engagement with bristle means of the other of said roller brushes, wherein the comb is passable between said roller brushes and into concurrent scrubbing engagement with the bristle means of each roller brush.

4. A cleaning assembly as in claim 3 wherein at least one of said roller brushes is rotatably mounted in direct fluid receiving position relative to cleaning fluid exiting from said first compartment and second valve assembly, the other of said roller brushes disposable in fluid transferring engagement with the oppositely positioned roller brush, whereby cleaning fluid is dispersed on both said roller brushes upon rotation thereof and on device to be cleaned engaging at least one of said roller brushes.

* * * * *